US005866875A

United States Patent [19]

Okabayashi

[11] Patent Number: 5,866,875

[45] Date of Patent: Feb. 2, 1999

[54] FIXING DEVICE AND FIXING METHOD

[75] Inventor: Eiji Okabayashi, Toyokawa, Japan

[73] Assignee: Minolta Co., Ltd., Osaka, Japan

[21] Appl. No.: 783,542

[22] Filed: Jan. 14, 1997

[30] Foreign Application Priority Data

Jan. 16, 1996 [JP] Japan ..... 8-004633

[51] Int. Cl.[6] ..... G03G 15/20

[52] U.S. Cl. ..... 219/216; 399/329

[58] Field of Search ..... 219/216; 399/328–333

[56] References Cited

U.S. PATENT DOCUMENTS

| | | | |
|---|---|---|---|
| 5,149,941 | 9/1992 | Hirabayashi et al. | 219/216 |
| 5,153,656 | 10/1992 | Johnson | 219/216 |
| 5,250,998 | 10/1993 | Ueda et al. | 399/329 |
| 5,345,300 | 9/1994 | Uehara et al. | 399/329 |
| 5,359,401 | 10/1994 | Uehara et al. | 219/216 |
| 5,371,571 | 12/1994 | Asanae | 399/329 |
| 5,614,999 | 3/1997 | Kanesawa et al. | 399/329 |
| 5,621,512 | 4/1997 | Uehara et al. | 399/328 |
| 5,666,624 | 9/1997 | Kanesawa et al. | 399/329 |

FOREIGN PATENT DOCUMENTS

| | | |
|---|---|---|
| 59-189381 | 10/1984 | Japan . |
| 61-130973 | 6/1986 | Japan . |
| 4-52770 | 11/1992 | Japan . |
| 7-181819 | 7/1995 | Japan . |

*Primary Examiner*—Teresa J. Walberg
*Assistant Examiner*—J. Pelham
*Attorney, Agent, or Firm*—McDermott, Will & Emery

[57] ABSTRACT

The present invention is related to a fixing device for fusing and fixing an unfixed toner image on a recording sheet. In the fixing device, a heating member such as rollers and endless belts and the like, is heated to a fixing temperature. An endless belt is provided opposite the heating member and is pressed against the heating member by a pressure member provided inside the endless belt. The heating member is driven in rotation in a transport direction of the recording sheet and the endless belt is driven in conjunction with the rotation of the heating member. The recording sheet bearing a toner image passes between the heating member and the endless belt while in this state, and the toner image is heated by the heating member so as to be fused onto the recording sheet under the pressure produced between the heating member and endless belt while the recording sheet is transported therebetween.

19 Claims, 4 Drawing Sheets

FIXING DEVICE AND FIXING METHOD

BACKGROUND OF THE INVENTION

1. Field of the Invention

The present invention relates to a fixing device and fixing method, and more specifically relates to a fixing device and fixing method for thermally fixing a toner image on a recording sheet in image forming apparatuses of the electrophotographic type such as copiers, printers, facsimile machines and the like.

1. Description of the Related Art

In image forming apparatuses of the electrophotographic type such as copiers, printers, facsimile machines and the like, normally a toner image maintained on a recording material (paper sheet) is transported between a heating member and a backup member arranged opposite said heating member, and said toner image is heated while under application of pressure so as to fuse said toner image on said recording sheet. The aforesaid heating member and backup member are endless type members such as rollers and belts capable of rotational movement so as to transport a recording sheet, and are often endless type members such as roller or belts which grip and transport a recording sheet therebetween as the pressure-applying member presses against the heating member.

In the fixing process, electric power is supplied to a heating unit and the surface temperature of a heating member is elevated to a predetermined temperature required to fuse a toner image on a recording sheet, and it is advantageous from a user perspective that the heating time required for the temperature elevation from the initial application of electric current until said predetermined temperature is attained (i.e., so-called "warm-up time") is as short as possible.

To such an end various proposals have been made to reduce the warm-up time as much as possible, e.g., Japanese Laid Open Patent Application No. HEI 61-130973 discloses as the aforesaid pressure member an endless belt looped around two rollers and which makes pressure contact with a heating roller. The use of an endless belt allows for a compact heating roller and the setting of suitable fixing pressure and nip between said heating roller and a suitable endless belt to assure fixing, and further allows for a smaller heating capacity due to the more compact heating roller, thereby reducing the warm-up time.

Japanese Utility Model Application No. HEI 4-52770 discloses a pressure member comprising a contact pressure sheet which presses against a heating roller. The use of this contact pressure sheet provides for reduced heating capacity and thus reduces the warm-up time.

On the other hand, the aforesaid endless belt which makes pressure contact with the heating roller disclosed in Japanese Laid Open Patent Application No. HEI 61-130973 is disadvantageous inasmuch as heat from the heating roller is captured by the two rollers around which the endless belt is looped, thereby increasing the warm-up time.

Furthermore, the contact pressure sheet disclosed in Japanese Utility Model Application No. HEI 4-52770 is disadvantageous in terms of the transportability of the recording sheet because the surface of the contact pressure sheet does not move in conjunction with the recording sheet but rather is stationary at a fixed position, and due to the difficulty of maintaining balanced pressure application on bilateral sides of said contact pressure sheet, thereby causing slipping of the recording sheet and skewing of the recording sheet due to unbalanced pressure application on bilateral sides of said sheet, and ultimately causing image drift. Thus this arrangement is disadvantageous in terms of recording sheet transportability and quality of the obtained image.

SUMMARY OF THE INVENTION

In view of the previously described disadvantages, an object of the present invention is to provide an improved fixing device and fixing method.

A further object of the present invention is to provide a fixing device and fixing method capable of producing images of excellent quality.

A still further object of the present invention is to provide a fixing device and fixing method which reduce warm-up time and provide excellent recording sheet transportability.

These and other objects of the present invention are achieved by providing a fixing device for fusing an unfixed toner image on a recording sheet, said fixing device comprising:

a heating member which is heated to a fixing temperature, and that is movable such that the surface of which is capable of transporting said recording sheet;

an endless belt provided opposite said heating member;

a pressure member provided inside said endless belt so as to press said endless belt against said heating member from the interior side of said belt so as to cause the rotation of said endless belt in conjunction with the movement of the surface of said heating member.

These and other objects of the present invention are further achieved by providing a fixing method comprising the steps of:

arranging a heat-resistant endless belt opposite a heating member heated to a fixing temperature and movable such that the surface transports said recording sheet;

pressing said endless belt against said heating member via a pressure member from the interior side of said endless belt;

driving the heating member while said endless belt is pressed thereupon; and transporting a recording sheet bearing an unfixed toner image between said heating member actuated via the aforesaid drive step and said endless belt driven by the aforesaid actuation of said heating member.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

This application is based on Patent Application No. 8-4633 filed in Japan, the content of which is incorporated hereinto by reference.

The preferred embodiments of the present invention are described hereinafter with reference to the accompanying drawings.

Figure 1A:
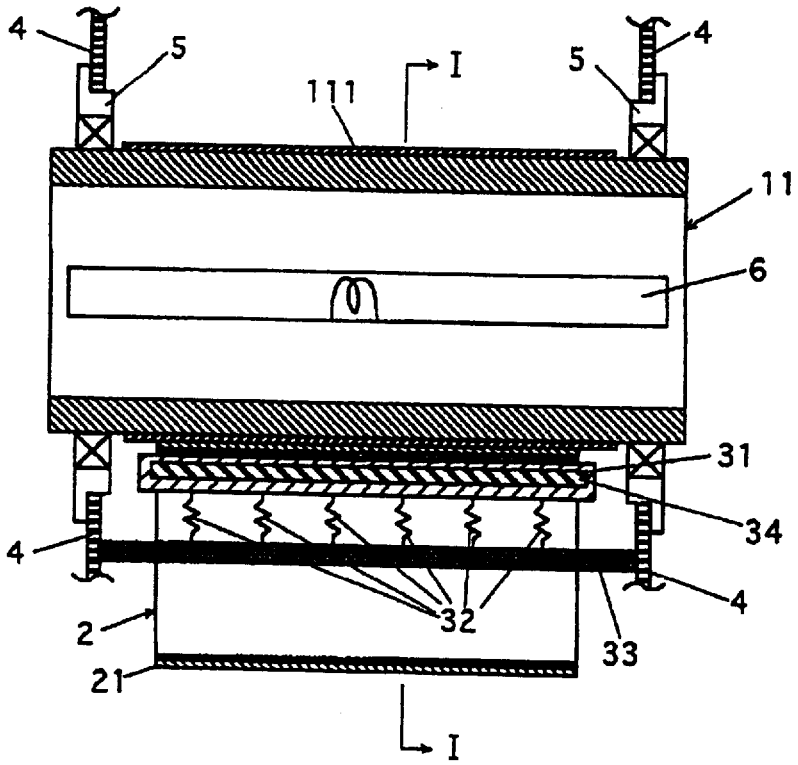
FIG. 1(A) is a section view briefly showing the construction of the fixing device of a first embodiment.
Figure 1B:
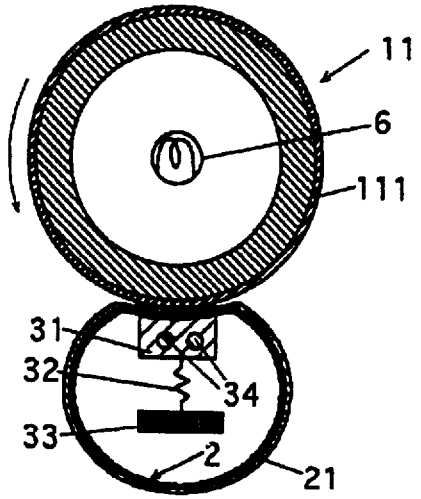
FIG. 1(B) is a simple section view showing the fixing device along the I—I line of FIG. 1(A)

The fixing device shown in FIGS. 1(A) and 1(B) thermally fuses a toner image onto a recording sheet. The heating member of this fixing device is a heating roller, which is heated by means of a built in halogen lamp heater. FIG. 1(A) is a brief section view of this fixing device, and FIG. 1(B) is a brief section view of this fixing device shown along the I—I line of FIG. 1(A).

The fixing device shown in FIGS. 1(A) and 1(B) comprises a heating roller 11, halogen lamp 6 provided within said heating roller 11, and an endless belt 2 which presses against said heating roller 11.

Heating roller 11 is formed mainly of a hollow aluminum cylinder, and is supported on housing 4 of the fixing device via a pair of bearings 5 on bilateral ends thereof so as to be rotatable. Heating roller 11 is rotated in the arrow direction shown in FIG. 1(B) via a drive means not shown in the drawing, such that a recording sheet is transported in the transport direction via the rotation of the roller.

A halogen lamp heater 6 is provided within the hollow portion of heating roller 11, and is supported via a support mechanism not shown in the illustration. Heater 6 is connected to a power source, and radiantly heats the heating roller 11 from the interior surface thereof via a voltage applied to the heater 6 from said power source.

The exterior surface of the aluminum cylinder is provided with a separation layer 111 comprising polytetrafluoroethylene (PTFE) or polyphenylene alkoxy ether (PFA) to form the heating roller 11. Separation layer 111 allows the heated toner image to easily separate from heating roller 11 when the recording sheet is gripped by and passes between the heating roller 11 and the endless belt 2 which is pressed against said heating roller 11 as described later.

The endless belt 2 comprises a heat-resista nt polyimide film having a thickness of 40 to 50 $\mu$m, and the exterior surface of which is provided with a thin silicone rubber layer 21 formed of silicone rubber. The interior surface of this film is coated with grease as a lubricant. The thin silicone rubber layer 21 improves the recording sheet transportability by preventing or adequately suppressing slippage and the like of the recording sheet.

The endless belt 2 is pressed against the heating roller 11 from the interior side of said belt via a pressure member 31 provided on the interior side of said endless belt 2. This pressure member 31 applies pressure on the opposing endless belt toward the heating roller 11 via a plurality of springs 32 (e.g., six springs in the present embodiment) provided on support member 33 fixedly attached to housing 4 of the fixing device and passing through said belt 2. The pressure member 31 is comprised of flexible silicone rubber and has a slight concave shape along heating roller 11 at the nip area with said heating roller 11. A pair of heaters 34 are provided within the pressure member 31 to prevent curling of the recording sheet. Each heater 34 is connected to a power source so as to heat the recording sheet through the endless belt 2 when heated via the application of a voltage from said power source.

According to the fixing device shown in FIGS. 1(A) and 1(B), the endless belt 2 is pressed against the heating roller 11 via the pressure member 31 before fixing starts, and during fixing, a voltage is supplied from a power source (not illustrated) to halogen lamp heater 6, such that the heating roller 11 is heated from its interior surface to a predetermined fixing temperature via said heater 6. Although the heat of heating roller 11 is transmitted to the endless belt 2 and the pressure member 21 which are in contact with the heating roller at this time, only a small amount of heat is transferred from the heating roller 11 to the endless belt 2 and pressure member 31 simply because the pressure member 31 is pressed against the heating roller 11 and not because the heat-resistant film comprising the endless belt 2 is formed at a thickness of 40 to 50 $\mu$m and, therefore, itself has only a small heat capacity and is looped around a drive pulley and driven pulley which have large heat capacities, thereby reducing the warm-up time of the fixing device.

Before or after the surface temperature of the heating roller 11 attains a predetermined fixing temperature, the heating roller 11 is driven in rotation in the transport direction of the recording sheet and the endless belt 2 is driven in rotation in conjunction with the rotation of the heating roller 11, and if a recording sheet bearing a toner image passes between the heating roller 11 and the endless belt 2 while in this state, said toner image is heated by the heating roller 11 so as to be fused onto the recording sheet under the pressure produced between the heating roller 11 and endless belt 2 while the recording sheet is transported therebetween. At this time, the endless belt 2 presses against the recording sheet and the surface of said belt 2 moves in conjunction with the movement of said recording sheet so as to provide excellent transport of the recording sheet. A separation layer 111 is formed on the exterior surface of the heating roller 11 which comes into contact with the recording sheet and prevents or adequately suppresses adhesion of the recording sheet or image formed thereon to the surface of the heating roller 11, and the thin silicone rubber layer 21 formed on the exterior surface of the endless belt 2 prevents or adequately suppresses slippage of the recording sheet, so as to allow excellent fixed images to be obtained.

Furthermore, the interior surface of the endless belt 2 is coated with grease to minimize the friction resistance of the pressure member 31 and endless belt 2, and provide smooth relative oscillation between the two members.

Curling of the recording sheet after passing through the fixing device is prevented or adequately suppressed when the recording sheet is transported between the heating roller 11 and endless belt 2 under heat and pressure because the heating is provided on both surfaces of the recording sheet via heating roller 11 and heaters 34 built into the pressure member 31 pressing endless belt 2.

When a heating roller is used as the heating member, a resistance heater or induction coil formed in a heating roller may be used as the mechanism for heating the heating roller as shown in FIGS. 2(A), 2(B), 3(A), and 3(B). The fixing devices shown in FIGS. 2(A), 2(B), 3(A), and 3(B) are essentially identical to the fixing device shown in FIG. 1 with the exception of the mechanism for heating the heating roller. Parts having essentially identical construction and functions are designated by Reference numbers identical to those of FIGS. 1(A) and 1(B).

Figure 2A:
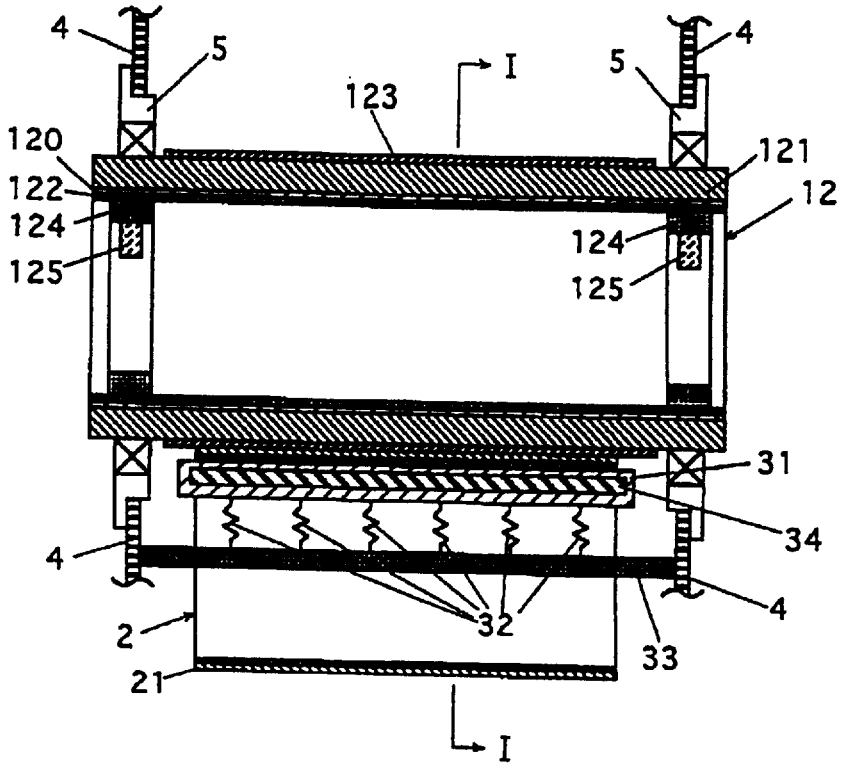
FIG. 2(A) is a section view briefly showing the construction of the fixing device of a second embodiment.
Figure 2B:
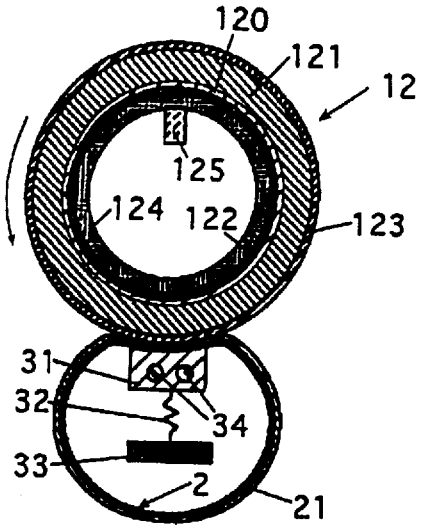
FIG. 2(B) is a simple section view showing the fixing device along the I—I line of FIG. 2(A)

In the fixing device of FIGS. 2(A) and 2(B), the heating mechanism is a resistance heater formed as a core roller of the heating roller. FIG. 2(A) is a brief cross-section view of this fixing device, and FIG. 2(B) is a brief cross-section view along the I—I line of the device of FIG. 2(A).

Figure 3A:
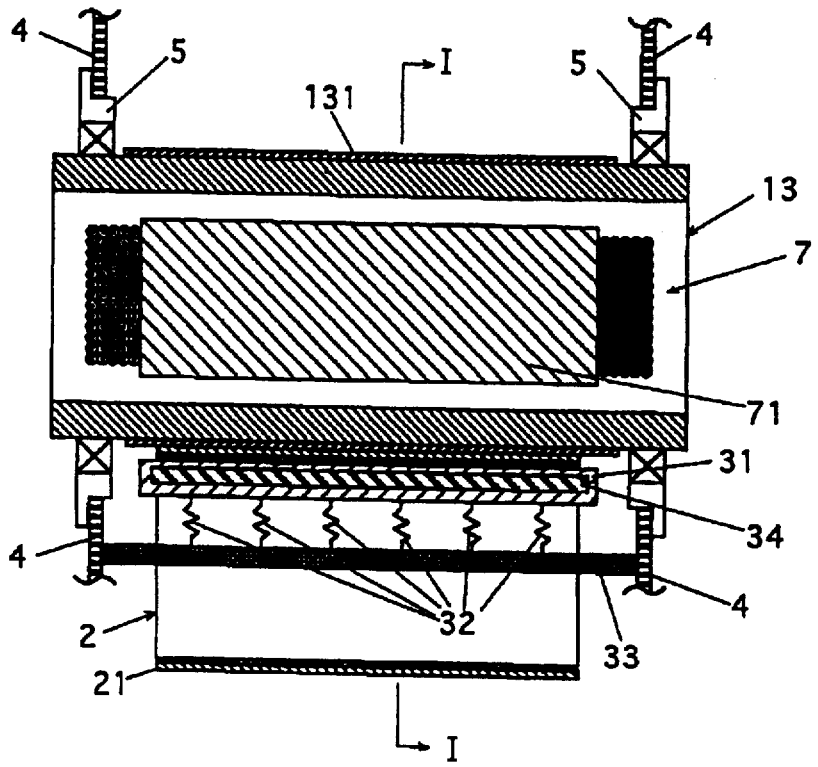
FIG. 3(A) is a section view briefly showing the construction of the fixing device of a third embodiment.
Figure 3B:
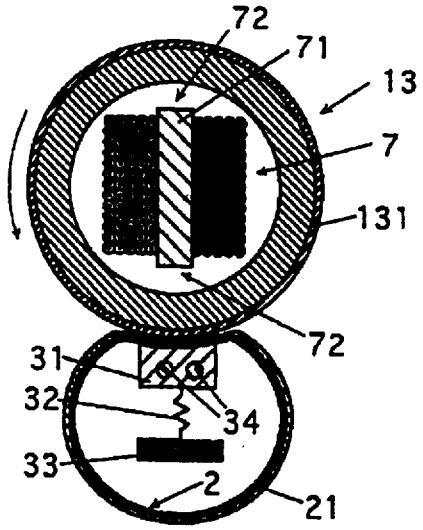
FIG. 3(B) is a simple section view showing the fixing device along the I—I line of FIG. 3(A)

In the fixing device of FIGS. 3(A) and 3(B), the heating mechanism is an induction coil built into the heating roller. FIG. 3(A) is a brief cross-section view of this fixing device, and FIG. 3(B) is a brief cross-section view along the I—I line of the device of FIG. 3(A).

The heating roller of the fixing device shown in FIGS. 2(A) and 2(B), disclosed in Japanese Laid Open Patent Application No. SHO 59-189381, herein incorporated by reference, is provided with a core roller 121 as a main element formed of a hollow cylindrical aluminum or iron ally tube. A layer-like resistance heater 121 comprised of barium titanate is formed on an electrically insulated layer 120 on the interior surface of the core roller 121, and a separation layer 123 is formed on the exterior surface of said core roller 121. Heating roller 121 is rotatably supported by the housing 4 of the fixing device via bearings 5 similar to the fixing device of FIGS. 1(A) and 1(B), so as to be rotatable in the arrow direction in FIG. 2(B) to transport a recording sheet in the sheet transport direction via said rotation of the heating roller.

A pair of power receiving members 124 formed of ring-shaped copper alloy are provided at bilateral ends of the interior surface of resistance heater layer 122, and a pair of carbon power supplying members 125 are arranged so as to contact the interior surface of said power receiving members 124. The power supplying members 125 are pressed toward the power receiving members 124 so as to maintain the electrical connection via the contact surface even when the power receiving members 124 rotate integratedly with the core roller 121.

Each power supplying member 125 is connected to a power source, such that the resistance heater layer 122 is heated to Joule heating when a voltage is applied from said power source to heat the interior surface of the heating roller 12.

The resistance heater layer may also be formed on the exterior surface of the core roller.

In this fixing device, an endless belt 2 is pressed toward the heating roller 12 in the same manner as in the fixing device of FIGS. 1(A) and 1(B).

The fixing device shown in FIGS. 2(A) and 2(B) is essentially identical to the fixing device shown in FIGS. 1(A) and 1(B) with the exception that the heating mechanism for heating the heating roller is changed from a halogen lamp heater to a resistance heater layer 122 formed on the interior surface of a core roller 121 and, therefore, the fixing device of FIGS. 2(A) and 2(B) reduces the warm-up time and provides excellent recording sheet transportability to produce images of excellent quality similar to the fixing device of FIGS. 1(A) and 1(B). This fixing device provides excellent electrical/heat conversion efficiency via the resistance heater layer 122, and is capable of rapidly heating the entire heating roller because the core roller is heated directly without radiant heating as is produced by the halogen lamp heater of the fixing device shown in FIGS. 1(A) and 1(B). Accordingly, warm-up time can be reduced even further than is achieved by the fixing device of FIGS. 1(A) and 1(B).

The heating roller 13 of the fixing device shown in FIGS. 3(A) and 3(B) is a hollow cylinder formed of electrically conductive material such as iron, nickel, or stainless steel, and is rotatably supported on housing 4 of the fixing device via bearings 5 similar to that of the fixing device shown in FIGS. 1(A) and 1(B), so as to be rotatable in the arrow direction in FIG. 3(B) via a drive mechanism (not illustrated) to transport a recording sheet in the sheet transport direction by means of said rotation of the heating roller.

An induction coil 7 is supported within the hollow interior of heating roller 13 with a space therebetween. A separation layer 131 is formed on the exterior surface of the heating roller 13.

A The induction coil 7 is formed by winding copper wire on a bobbin 71, and the two coil faces 72 confront the interior surface of the heating roller 13 in a vertical direction shown in FIG. 3(B). The induction coil 7 is connected to a high frequency power source, such that the heating roller is induction heated via an induction current generated in the heating roller 13 via a voltage supplied by said high frequency power source.

The induction coil also can be arranged in the vicinity of the heating roller on the exterior side of said heating roller. Furthermore, the induction coil also may be constructed as an assembly of a plurality of coils in parallel and serial connections, in which case the amount of generated heat in the coil part of parallel connections and the coil part of serial connections may differ by the position of each coil along the center line direction of the heating roller being inductively heated by each coil and supplying different current to each said coil. For example, when the amount of heat developed at the bilateral ends of the heating roller is greater than the heat developed at the center part of the heating roller, the temperature distribution can be made uniform along the center line direction of rotation of the heating roller.

The endless belt 2 of the present fixing device is pressed against the heating roller 13 in the same manner as the fixing device of FIGS. 1(A) and 1(B).

The fixing device shown in FIGS. 3(A) and 3(B) is essentially identical to the fixing device shown in FIGS. 1(A) and 1(B) with the exception that the heating mechanism for heating the heating roller is changed from a halogen lamp heater to an induction coil built into heating roller 13 and, therefore, the fixing device of FIGS. 3(A) and 3(B) reduces the warm-up time and provides excellent recording sheet transportability to produce images of excellent quality similar to the fixing device of FIGS. 1(A) and 1(B). This fixing device provides excellent heating of the heating roller 13 via the induction heating by induction coil 7 and, therefore, reduces warm-up time even further than is achieved by the fixing device of FIGS. 1(A) and 1(B).

Figure 4A:
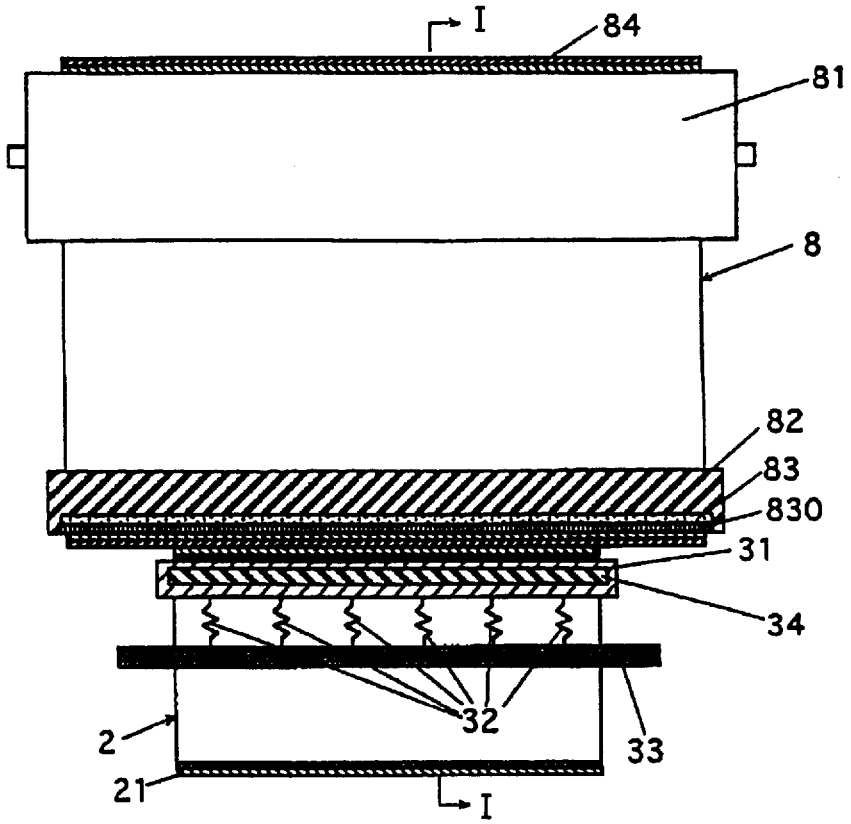
FIG. 4(A) is a section view briefly showing the construction of the fixing device of a fourth embodiment.
Figure 4B:
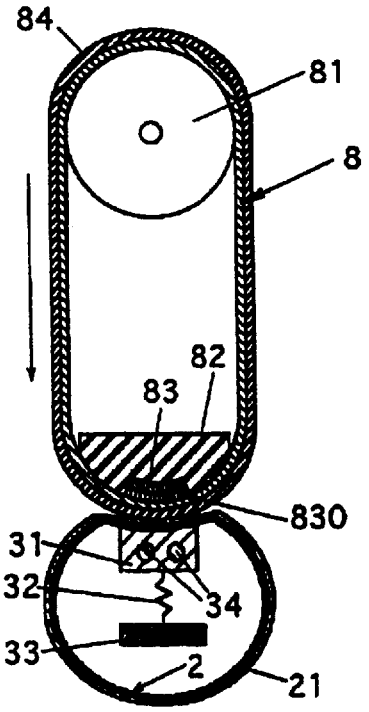
FIG. 4(B) is a simple section view showing the fixing device along the I—I line of FIG. 4(A)

Another embodiment of the fixing device of the present invention is described hereinafter with reference to FIGS. 4(A) and 4(B). This fixing device uses a heat-resistant endless belt as a heating member which is heated by a heating unit that includes a heating element for generating heat via a pulse-like current. FIG. 4(A) is a brief cross-section view of this fixing device, and FIG. 4(B) is a brief cross-section view of said fixing device along the I—I line of FIG. 4(A).

This fixing device is provided with a heat-resistant film 8 as a heating member, and an endless belt 2 is provided which presses against said film 8 in the same manner as in the fixing device of FIGS. 1(A) and 1(B).

The film 8 comprises a PFA resin film or polyethylene terephthalate (PET) film subjected to heat resistance processing, and which is formed as an endless belt having a thickness of 50 $\mu$m. A drive roller 81 and heating unit 82 are arranged on the interior surface of film 8 which is looped therearound. A separation layer 84 is formed on the exterior surface of film 8.

The heating unit 82, disclosed in U.S. Pat. No. 5,149,941, herein incorporated by reference, is arranged opposite the pressure member 31 of the endless belt 2, and for example, includes an aluminum main member 82 which supports a heater 82, and a part of which is formed as a convex curved surface that is pressed against the endless belt 2 as shown in FIG. 4(B). The heater 83 comprises a linear, small thermal capacity heat-producing line formed of $Ta_2N$, which is instantly heated to high temperature via a pulse current and which rapidly cools when said current is turned OFF; a flexible overcoat layer 830 comprising $Ta_2O_5$ covers the exposed surface from the main member on the bottom surface of heating unit 82, such that the bottom surface of the heating unit 82 including said protective layer 830 is in contact with the film 8. The heater 83 is connected to a power source not shown in the drawings, and generates heat via a pulse current supplied by said power source to heat the film 8. In this case, the current pulse width is controlled by a control means not shown in the illustrations, so as to control the heater temperature heating unit 82 within a predetermined range.

A drive roller 81 is supported so as to be rotatable, and moves the surface of film 8 in the arrow direction in FIG. 4(B) via a drive mechanism to transport a recording sheet in the sheet transport direction via the movement of the surface of said film 8.

The heat-resistant film is not limited to an endless belt configuration as in the present embodiment, inasmuch as it may have a belt-with-ends configuration. In this case, for example, consider that one end of the heat-resistant film is wound upon a rotating reel and the other end of the film is connected to another drive reel which is drivably rotated so as to move the surface of the heat-resista nt film in the transport direction of the recording sheet.

The exterior surface of the endless belt 2 is provided with a silicone rubber layer 21 identical to the endless belt of the fixing device shown in FIGS. 1(A) and 1(B), and the endless belt 2 is pressed against the heating unit 82 and heat-resistant film 8 functioning as a heating member via the pressure member 31, spring 32, and spring support member 33 arranged on the interior side of the endless belt 2.

According to this fixing device, the endless belt 2 is pressed against the heating unit 82 through the heat-resistant film 8 via the pressure member 31 before fixing starts, and in this state a current is supplied to heater 83 and the surface of heat-resistant film 8 is heated to a predetermined fixing temperature via heating unit 82 which is heated by the heater 83. Although the heat of the heat-resistant film 8 is transmitted to the endless belt 2 and the pressure member 31 which are in contact with said film at this time, only a small amount of heat is transferred from the heat-resistant film 8 to the endless belt 2 and pressure member 31 simply because the pressure member 31 presses the heat-resistant film 8 into contact with the heating unit 82 and the heat-resistant film comprising the endless belt 2 itself has a small heat capacity due to its thickness of 40 to 50 $\mu$m thereby reducing the warm-up time of the fixing device. The warm-up time is further reduced because the heater 83 is rapidly heated via the pulse current, thereby allowing a fixing temperature to be easily and accurately maintained by controlling the pulse current.

Before or after the surface temperature of the heat-resistant film 8 attains a predetermined fixing temperature, the heat-resistant film 8 is driven in rotation in the transport direction of the recording sheet via drive roller 81 such that the endless belt 2 is driven in rotation in conjunction with the rotation of said heat-resistant film 8, and if a recording sheet bearing a toner image passes between the heat-resistant film 8 and the endless belt 2 while in this state, said toner image is heated by the heat-resistant film 8 so as to be fused onto the recording sheet under the pressure produced between the heat-resistant film 8 and the endless belt 2 while the recording sheet is transported therebetween. At this time, the endless belt 2 presses against the recording sheet and the surface of said belt 2 moves in conjunction with the movement of said recording sheet so as to provide excellent transport of the recording sheet. A separation layer 84 is formed on the exterior surface of the heat-resistant film 8 which comes into contact with the recording sheet and prevents or adequately suppresses adhesion of the recording sheet or image formed thereon to the surface of the film 8. Furthermore, the thin silicone rubber layer 21 formed on the exterior surface of the endless belt 2 prevents or adequately suppresses slippage of the recording sheet, so as to allow excellent fixed images to be obtained. In addition, the interior surface of the endless belt 2 is coated with grease to minimize the friction resistance of the pressure member 31 and endless belt 2, and provide smooth relative oscillation between the two members.

Curling of the recording sheet after passing through the fixing device is prevented or adequately suppressed when the recording sheet is transported between the film 8 and endless belt 2 under heat and pressure because the heating is provided on both surfaces of the recording sheet via the heating unit 82 through heat-resistant film 8 and via the heater 34 built into the pressure member 31 pressing endless belt 2.

In the previously described first through fourth embodiments, nickel or similar metal may be used as the endless belt 2. Whatever the material of the endless belt 2, it is desirable that said belt 2 have a thickness of less than 100 $\mu$m to minimize the heat capacity of said belt and reduce the warm-up time of the fixing device. Furthermore, a lubricant such as grease or the like may be applied to the interior surface of the endless belt to minimize friction resistance between the endless belt and the belt pressure means.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A fixing device for fusing an unfixed toner image on a recording sheet, said fixing device comprising:

a heating member which is heated to a fixing temperature, and having a movable surface for transporting said recording sheet;

an endless belt provided opposite said heating member;

a pressure member provided inside said endless belt for pressing said endless belt against said heating member from the interior side of said belt effecting rotation of said endless belt in conjunction with the movement of the surface of said heating member, wherein only said pressure member presses the inside of said endless belt.

2. The fixing method as claimed in claim 1, wherein said heating member includes a roller, and the fixing device further comprises a heater which is provided within said roller and radiantly heats said roller from an interior surface of said roller.

3. The fixing device as claimed in claim 2, wherein said heater includes a halogen lamp.

4. The fixing device as claimed in claim 1, wherein said heating member includes a roller and the fixing device further comprises a resistance heater which is provided on the surface of said roller and is heated to Joule heating when a voltage applied to heat said roller.

5. The fixing device as claimed in claim 4, wherein said resistance heater is provided on the interior surface of the roller.

6. The fixing device as claimed in claim 4, wherein said resistance heater is provided on the exterior surface of the roller.

7. The fixing device as claimed in claim 1 wherein said heating member is formed of electrically conductive material and the fixing device further comprises an induction coil which is connected to a high frequency power source and generates an induction current in said heating member so that the heating member is induction heated.

8. The fixing method as claimed in claim 1, wherein said heating member includes an endless heat-resistant film, and the fixing device further comprises a heater that generates heat via a pulse current supplied by a power source to heat said endless heat-resistant film.

9. The fixing device as claimed in claim 1 wherein said endless belt includes a heat-resistant polyimide film having a thickness of 40 to 50 $\mu$m and exterior surface of which is provided with a thin silicone rubber layer formed of silicone rubber.

10. The fixing device as claimed in claim 1 wherein an interior surface of said endless belt is coated with grease as a lubricant.

11. The fixing method as claimed in claim 1, wherein said pressure member includes flexible silicone rubber and has a slight concave shape along the heating member at a nip area with the heating member.

12. The fixing device as claimed in claim 1 further comprising a heater is provided within the pressure member.

13. A method of fusing an unfixed toner image on a recording sheet comprising the steps of:

arranging an endless belt opposite a heating member heated to a fixing temperature, said heating member having a movable surface for transporting said recording sheet;

pressing said endless belt against said heating member via a pressure member from the interior side of said endless belt, wherein only said pressure member presses the inside of said endless belt;

driving the heating member while said endless belt is pressed thereupon; and transporting said recording sheet bearing said unfixed toner image between the driven heating member and said endless belt driven by said heating member.

14. The fixing method as claimed in claim 13, wherein said heating member includes a roller and the fixing method further comprises a step of radiantly heating said roller form an interior surface of the roller by a heater which is provided within said roller.

15. The fixing method as claimed in claim 13, wherein said heating member includes a roller and the fixing method further comprises a step of heating said roller by a resistance heater which is provided on the surface of said roller and is heated to Joule heating when a voltage applied.

16. The fixing method as claimed in claim 13 wherein said heating member is formed of electrically conductive material and the fixing method further comprises a steps of heating the heating member by applying a high frequency current to an induction coil provided in vicinity of said heating member.

17. The fixing method as claimed in claim 13 wherein said heating member includes an endless heat-resistant film and the fixing method further comprises a steps of heating said endless heat-resistant film by supplying a pulse current to a heater.

18. The fixing method as claimed in claim 13, wherein said endless belt includes a heat-resistant polyimide film having a thickness of 40 to 50 microns and an exterior surface of which is provided with a thin silicone rubber layer formed of silicone rubber.

19. The fixing method as claimed in claim 13, wherein an interior surface of said endless belt is coated with grease as a lubricant.

* * * * *